United States Patent [19]

Conforto et al.

[11] Patent Number: 4,744,197

[45] Date of Patent: May 17, 1988

[54] TRAY CARTON END FLAP AUXILIARY SEALER

[75] Inventors: Peter M. Conforto, Monroe, La.; Maxon L. Day, Cudahy, Wis.

[73] Assignee: Manville Corporation, Denver, Colo.

[21] Appl. No.: 77,834

[22] Filed: Jul. 27, 1987

[51] Int. Cl.[4] ..... B65B 49/12

[52] U.S. Cl. ..... 53/397; 53/374; 53/383; 493/141

[58] Field of Search ..... 53/383, 374, 375, 207, 53/209, 462, 397, 580; 493/183, 151, 141, 453

[56] References Cited

U.S. PATENT DOCUMENTS

| | | | |
|---|---|---|---|
| 3,405,503 | 10/1968 | Mizelle et al. | 53/230 X |
| 3,504,478 | 4/1970 | Dieter | 53/209 X |
| 4,480,421 | 11/1984 | Rece | 53/383 X |
| 4,519,181 | 5/1985 | Sherman et al. | 53/383 X |
| 4,562,687 | 1/1986 | Green, Jr. | 53/374 X |
| 4,651,501 | 3/1987 | Matsuda et al. | 53/383 |

*Primary Examiner*—James F. Coan

*Attorney, Agent, or Firm*—John D. Lister; Cornelius P. Quinn; Timothy R. Schulte

[57] ABSTRACT

In a machine for packaging articles in a tray carton a first stationary rail section folds up the end panels of a moving tray carton blank to an intermediate position and, after the application of glue to either the end flaps or the end panels, a third stationary rail section completes the operation of folding the end panels of the moving blank up against the end flaps. A second normally stationary section located between the first and third sections maintains the end panels in their intermediate positions. When the machine stops for any reason the second section moves the end panels of the tray carton located at that station into contact with the end flaps to adhere the end panels to the end flaps of the stationary tray carton.

8 Claims, 4 Drawing Sheets

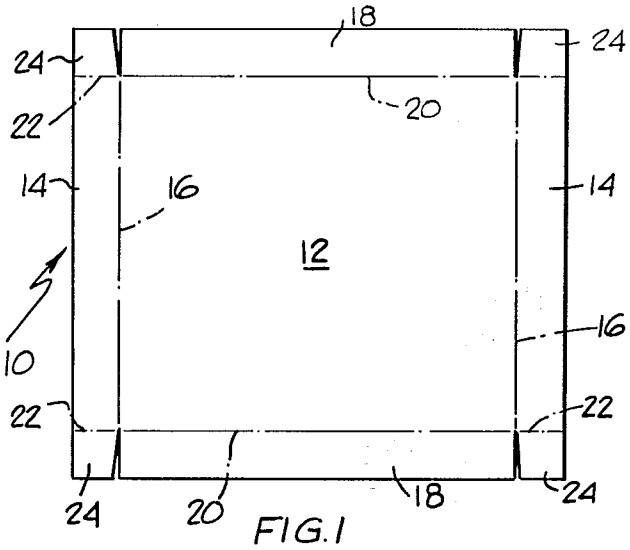
FIG. 1
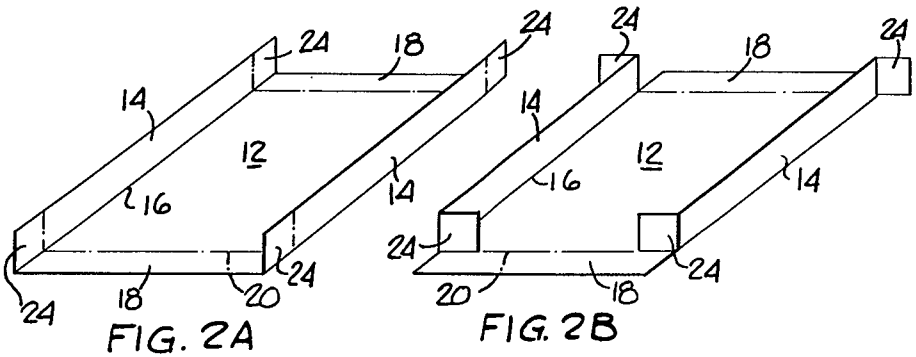
FIG. 2A
FIG. 2B
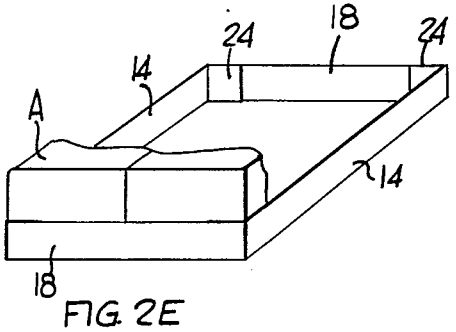
FIG. 2C
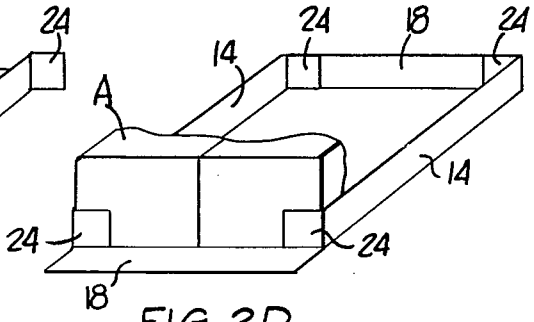
FIG. 2D
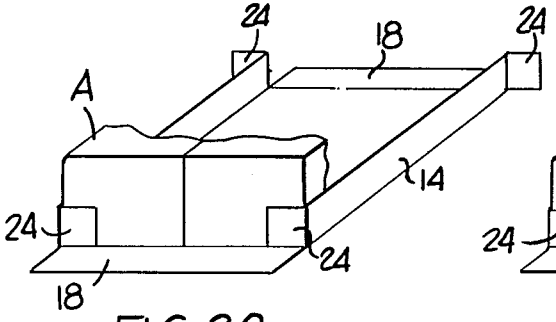
FIG. 2E

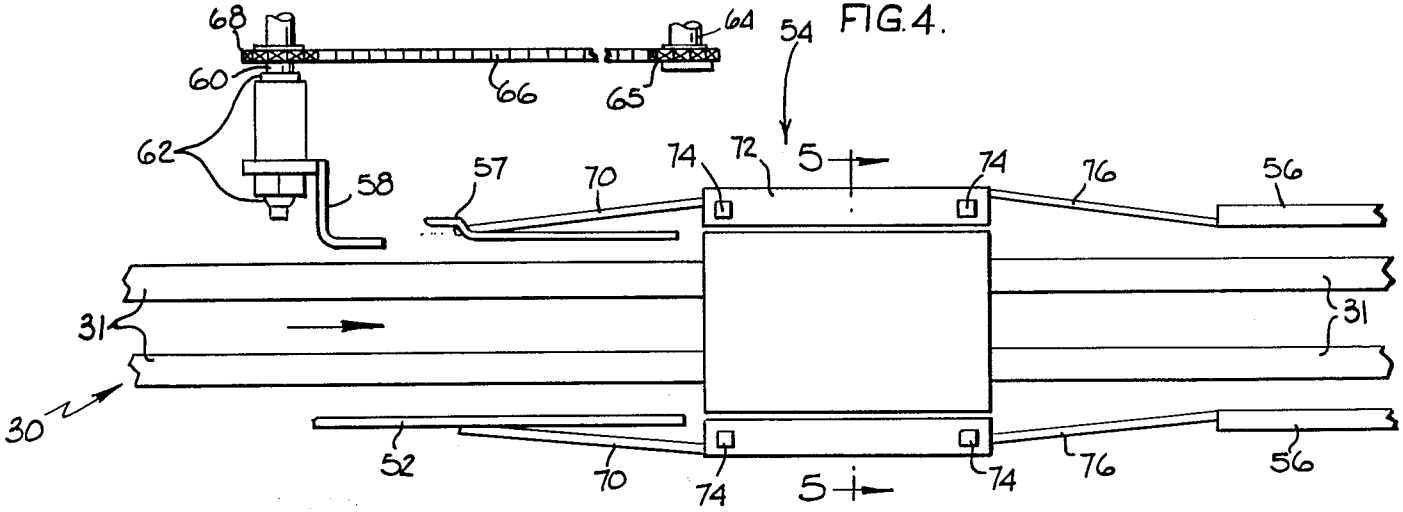
FIG. 4.
54
64
65
66
68
60
62
58
57
70
72
74
76
56
31
30
52
5
5
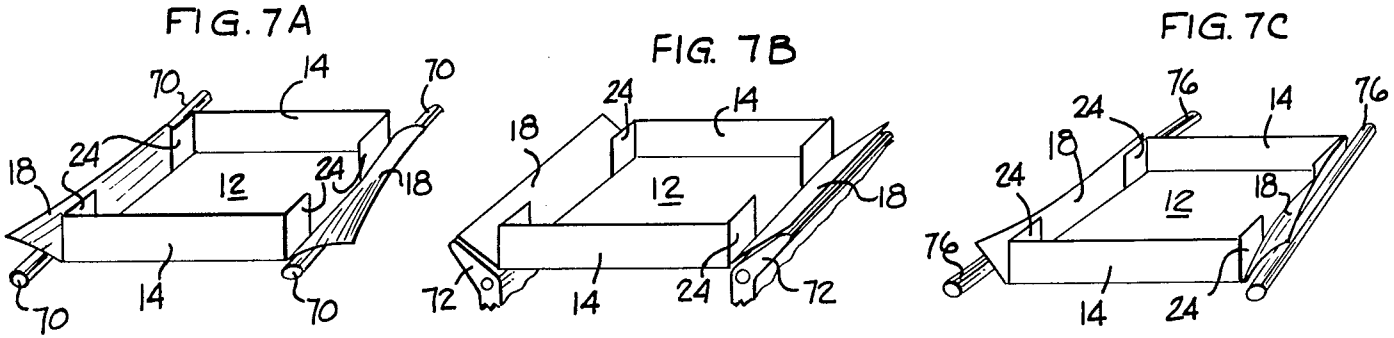
FIG. 7A
FIG. 7B
FIG. 7C
12
14
18
24
70
72
76

TRAY CARTON END FLAP AUXILIARY SEALER

FIELD OF THE INVENTION

This invention relates generally to the closing and sealing of the end panels of tray cartons. More particularly, it relates to the closing and sealing of the end panels of a tray carton which is at the panel closing station at the time the packaging machine stops.

BACKGROUND OF THE INVENTION

Bottles, cans and carriers containing bottles or cans are commonly packaged for shipment in tray cartons, which comprise a bottom panel foldably connected to relatively short side and end panels. In the packaging operation tray carton blanks are fed to a continuously operating packaging machine which moves the blanks at high speed and at the same time introduces the articles to be packaged and forms the cartons from the blanks.

Part of the carton forming operation consists of folding the end panels of the blanks up against end panel flaps and gluing the end panels to the flaps. This is conventionally done by employing static folding rails to gradually fold the end panels up into proper position as the filled carton blanks move by. Glue is applied just prior to the folding operation so that the end panels can be brought into contact with the end flaps before the glue dries. When the machine stops running, however, the carton in the closing and sealing station at the time is not fully sealed because the carton will not yet have reached the station where the end panels are brought into contact with the end flaps. By the time the machine starts up again the glue will have dried and the carton will not hold together.

This problem has been recognized in the past and attempts have been made to solve it. For example, U.S. Pat. No. 3,504,478, issued Apr. 7, 1970 to Dieter, discloses separate closers or plates for pushing the end panels up against the end flaps when the pnuematic circuit involved is actuated. At the same time the frame that holds the end flaps in their folded position must be moved away in order to make room for the closer plates to operate. These actions take place before the end panels have begun to be folded up toward the end flaps. This arrangement requires extra equipment which is relatively bulky and which tends to require maintenance itself. Further, it takes up space on the machine which otherwise could be used for the basic tasks of feeding and fabricating the tray cartons.

Another approach to the problem is disclosed in U.S. Pat. No. 4,562,687, issued Jan. 7, 1986 to Green, Jr., which discloses the use of folding plates having a component of movement in the direction of travel of the tray cartons. The positive folding action employed adheres the end panels of each tray carton to the end flaps, including the carton at the sealing station at the time of a machine shutdown. While this approach eliminates the problem discussed above, it requires moving parts to carry out the normal folding and sealing process and as such is subject to more equipment maintenance and equipment failure. Further, greater machine speeds are possible with stationary rail folders.

It would be desirable to provide means for sealing the end panels to the end flaps in a simple yet efficient manner which can readily be incorporated in a conventional tray carton packaging machine.

BRIEF SUMMARY OF THE INVENTION

This invention provides end panel folding means which can be actuated for movement toward the end flaps of a tray carton when the packaging machine stops running. The end panel folding means comprises a stationary first means for folding the moving end panels up from a flat unfolded position to an intermediate folded position, normally stationary second means for maintaining the moving end panels in their intermediate folded position, and stationary third means for folding the moving end panels up from their intermediate folded position to their final folded position against the end flaps. The normally stationary second means comprises guide plates mounted for pivotal movement about horizontal axes toward and away from the end flaps.

The normally stationary guide plates are part of the normal folding operation of the end panels and are actuated to move the end panels with which they are in contact up against the end flaps only when the machine stops. Thus they occupy little extra space and do not interfere with the ability of the packaging machine to operate at high speeds.

Other features and aspects of the invention, as well as its various benefits, will be made more clear in the detailed description of the invention which follows.

BRIEF DESCRIPTION OF THE DRAWINGS

FIG. 1 is a plan view of a blank used in the fabrication of a conventional tray carton of the type to which this invention relates;

FIGS. 2A–2E are sequential pictorial views of the folding of the blank of FIG. 1 to form a tray carton;

FIG. 4 is an enlarged view of the folding and sealing station shown in FIG. 3;

FIGS. 7A–7C are pictorial views showing in sequence the various stages of folding the end panels of the tray carton blank to form a tray carton.

DESCRIPTION OF THE INVENTION

Figure 3:
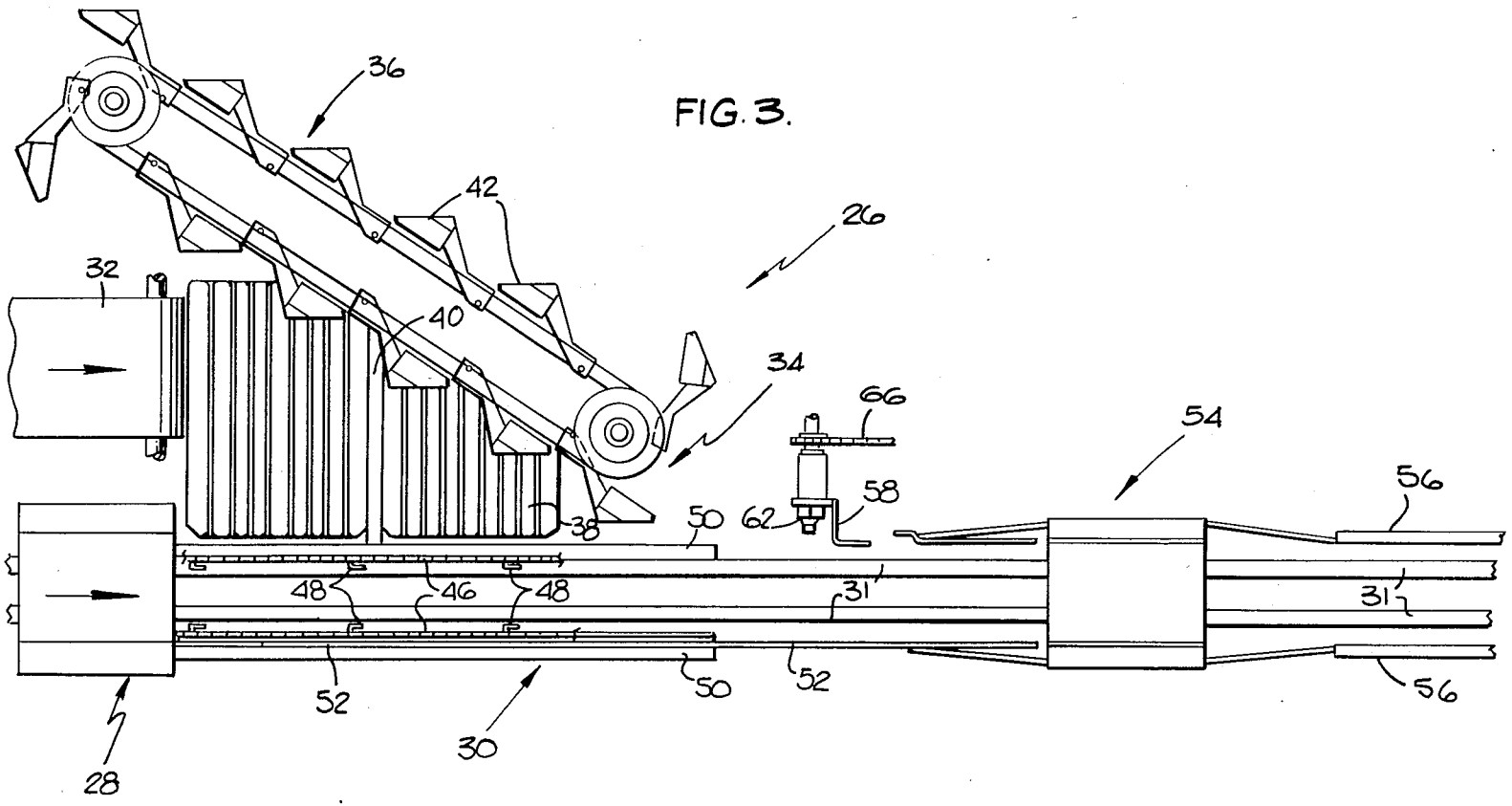
FIG. 3 is a schematic plan view of a portion of a packaging machine for fabricating and filling tray cartons of the type shown in FIGS. 1 and 2.

Referring to FIG. 1, a typical blank 10 used to form a tray carton is comprised of a bottom panel 12, side panels 14 connected to the bottom panel by fold lines 16 and end panels 18 connected to the bottom panel by fold lines 20. Connected to the end portions of the side panels 14 by fold lines 22 are end flaps 24.

As shown in FIG. 2A, the side panels of the blank 10 are first folded up along fold lines 16. The raised side panels form the leading and trailing panels of the blank as it travels through the packaging machine. Typically, the end flaps 24 at the entry end of the carton, that is, the end through which the articles to be packaged enter the tray, are then folded out as illustrated in FIG. 2B so as not to interfere with the movement of the articles into the tray. The other end flaps 24 are folded in as shown in FIG. 2B.

As shown in FIG. 2C the articles A are then introduced into the tray and subsequently the end flaps 24 at the entry end of the tray are folded in toward each other as shown in FIG. 2D. The end panels 18 are then folded up against the end flaps, as shown in FIG. 2E, and adhered to them by glue. The filled tray carton is then discharged from the packaging machine for further handling and shipping.

Referring to FIG. 3, the packaging machine to which this invention relates is indicated generally at 26 and comprises a carton blank hopper and feed station 28, a carton conveyor 30, an article infeed conveyor 32, and a basket chain conveyor 34. Overlying a portion of the basket chain conveyor 34 is a pusher plate conveyor 36. The operation of the machine to this point is conventional. Articles are delivered to the infeed conveyor 32 and are deposited by the infeed conveyor onto the basket chain conveyor 34. The articles may be single articles such as individual beverage bottles or cans or they may be larger units of such items, such as carriers holding six or twelve bottles or cans. In either case the speed of the article infeed conveyor is related to the speed of the basket chain conveyor 34 so that the desired number of articles to be packaged in a tray carton are loaded into each section 38 of the basket chain conveyor. Each section of the basket chain conveyor is separated from adjacent sections by bars 40 which are raised above the slatted surface of the basket chain conveyor. The pusher plates 42 are mounted on a continuous chain 44 of the pusher plate conveyor 36 which is angled with respect to the direction of movement of the infeed conveyor 32 and the carton conveyor 30. The faces of the pusher plates which contact the articles are parallel to the direction of movement of the infeed conveyor and the carton conveyor so that continued movement of the pusher plates 42 eventually pushes the articles off the basket chain conveyor 34 and onto the carton conveyor 30.

The carton conveyor 30 includes spaced support surfaces 31 located between endless chains 46 which carry lugs 48 at spaced intervals corresponding to the width of a tray carton. The lugs 48 not only push the cartons downstream, but also serve to fold up the side panels of the tray carton blank to the position shown in FIG. 2A. In addition, the lugs 48 and the separator bars 40 on the basket chain conveyor 34 cooperate to hold the end flaps 24 located at the article entry end of the carton conveyor 30 in the folded-back condition shown in FIGS. 2B and 2C. The end panels 18 ride beneath hold-down bars 50 which maintain the end panels in the flat unfolded position shown in FIGS. 2A–2D, and the flaps 24 on the side of the carton opposite the entry end are maintained in their closed folded-in position shown in FIG. 2B by flap retaining rod 52.

The tray blank hopper and feed section 28 can be of any specific design desired. For example, it can function in the manner of the system disclosed in U.S. Pat. No. 4,034,658, issued July 12, 1977 to Sherman. The other features of the packaging machine described thus far are explained in more detail in the aforementioned U.S. Pat. No. 4,562,687, the disclosures of both these patents being included herein by reference.

The machine of FIG. 3 also consists of a gluing and sealing station 54. The end panels 18 of the carton are folded up to an intermediate point just prior to reaching the gluing station, then after leaving the station they are folded up against the end flaps and held in place by compression bars 56. The compression bars 56, which may comprise any acceptable design of the prior art, are set so as to exert pressure on the ends of the carton for a predetermined distance as the cartons are moved by the carton conveyor 30 downstream from the gluing and sealing station 54. By the time the tray cartons exit from the compression bars the glue will have been dried and set and the cartons will be structurally sound. The cartons then continue downstream on the conveyor 30 to a point, not shown, where they are discharged for further handling.

Referring now to FIG. 4, as the filled partially erected cartons of FIG. 2C move downstream on the conveyor 30, the leading end flap 24 on the entry side of the carton will contact stationary flap folding rod 57 and be folded thereby back toward the trailing side panel 14. A finger 58, connected to rotating shaft 60, is adapted to rotate in a counterclockwise direction so as to strike the trailing end flap on the entry side of the carton and fold it forward toward the leading side panel. The trailing end flap will be exposed to the finger 58 at this point because it will have passed downstream from the basket conveyor 34 and will therefore no longer be held by the lugs 48 and the separator bars 40 in its folded-back position. The trailing end flap will be retained in its new folded-in position by the flap folding bar 57, and the filled carton at this point will correspond to the carton of FIG. 2D. The shaft 60 may be mounted for rotation in suitable journals 62 and may be powered through any convenient power train, such as by a drive shaft 64 connected by a sprocket 65 and chain 66 to a sprocket 68 attached to the shaft 60.

Situated slightly downstream from the end of the flap folding rod 57 on both sides of the conveyor 30 are static end panel folding bars 70 of conventional shape well known in the art. The function of the folding bars 70 is to initiate the upward folding of the end panels 18 so that the end panels are in an intermediate folded condition as the carton enters the gluing station 54. The action of the folding bars 70 is illustrated in FIG. 7A, wherein the downstream portions of the end panels are shown in their intermediate position while the upstream portions of the end panels are shown in the initial stage of being folded upwardly by the bars 70.

Still referring to FIG. 4, continued movement of the conveyor carries the carton into the gluing station 54 where plates 72 support and guide the end panels 18 to maintain them in the intermediate folded position established at the downstream end of the folding bars 70. The end panels receive adhesive while in the gluing station 54 from glue heads 74 located above the plates. The adhesive, which may be of any type suited for such an operation and is preferably of the hot melt type, is sprayed on the leading and trailing portions of the moving end panels so that it is located opposite the folded end flaps. The carton is shown while supported by the plates 72 during the normal continuous operation of the packaging machine in FIG. 7B.

As the carton leaves the gluing station 54 the end panels 18 come into contact with static folding bars 76, which are designed to continue and complete the folding of the end panels up against the end flaps 24. The carton at this stage is illustrated in FIG. 7C, wherein the downstream end of the end panels has been folded into contact with the end flaps but the upstream end is just in the process of being engaged by the upstream end of the folding bars 76. The adhesive on the end panels contacts the end flaps and the compression bars 56, as mentioned above, hold the end panels against the end flaps a sufficiently long time to allow the glue to set to permanently adhere the end panels to the end flaps.

Figure 5A:
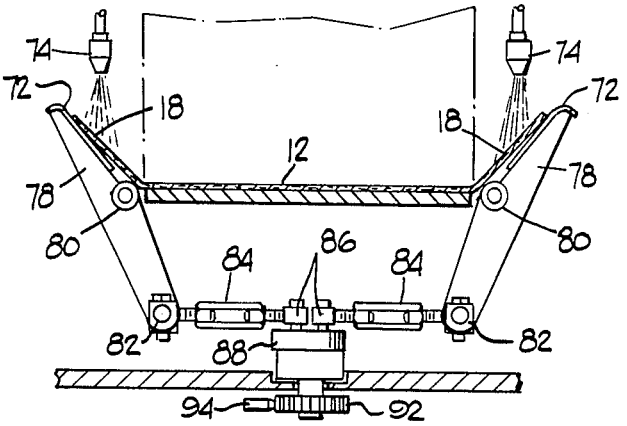
FIG. 5A is a sectional view taken on line 5—5 of FIG. 4 showing the normal stationary position of the plates which hold the end panels in their intermediate folded position.
Figure 5B:
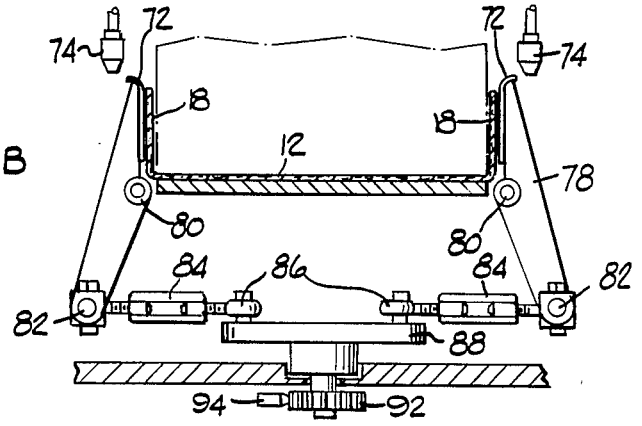
FIG. 5B is a sectional view similar to that of FIG. 5A, but showing the plates in their actuated position which holds the end panels in contact with the end flaps of the tray carton.
Figure 6:
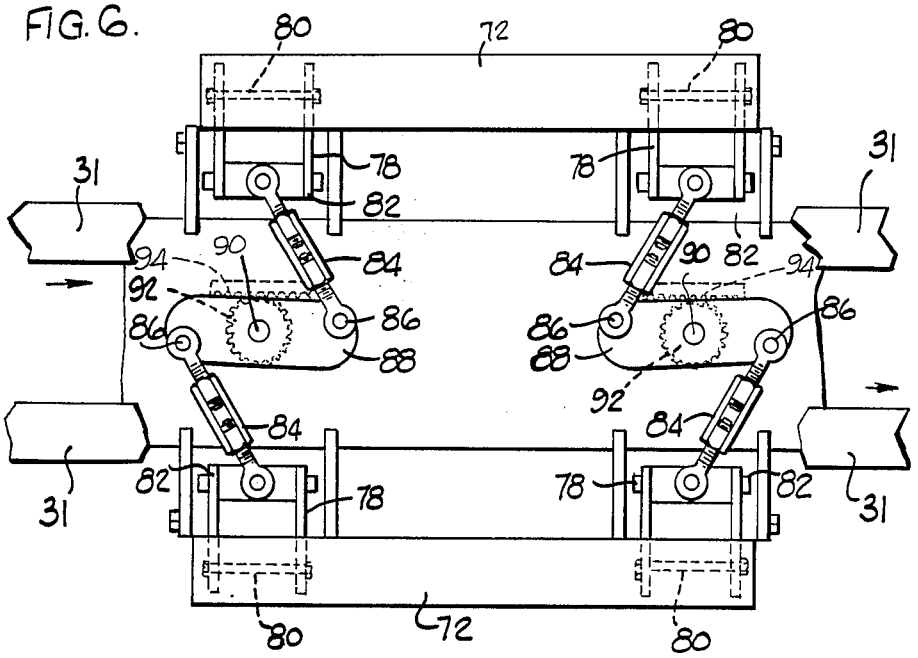
FIG. 6 is a plan view, with some intervening structure omitted for purpose of clarity, of the mechanism for actuating movement of the plates of FIGS. 5A and 5B.

Referring to FIG. 5A, the plates 72 are shown supporting the end panels 18 in the intermediate position illustrated in FIG. 7B, which is the normal operating position of the plates. As shown in both FIGS. 5A and 6, each plate 72 is supported at each end by a pair of spaced arms 78. The arms 78 are pivotally mounted in their central portions about horizontal axes 80 and are pivotally attached at their lower ends at 82 to links 84. The central portions of the links 84 are illustrated as comprising turnbuckles for purpose of adjustment. The opposite or inner ends of the links 84 are pivotally connected at 86 to the opposite ends of a plate 88 which is mounted on vertical shaft 90. Connected to the underside of the plate 88 is a pinion gear 92 also mounted on the shaft 90. The pinion gear 92 is operatively connected to a rack 94 which may be actuated for reciprocal movement by any desired means but preferably is powered by any of the well known types of pneumatic rotary actuators. The rotary actuator will cause movement of the rack 94 which will cause the pinion gear to rotate, in turn causing the plate 88 to rotate. The links 84 are thus caused to move the bottom ends of the arms 78 inwardly or outwardly, depending on the direction of rotation of the plate 88. When the plate 88 is rotated from the normal operating position shown in FIG. 6, the lower ends of the arms 78 are moved outwardly, causing the upper portions of the arms to move the plates 72 into the vertical position shown in FIG. 5B.

In operation, when the machine is shut down the rotary actuator or other rack drive means is actuated through suitable circuitry, not shown but well known in the art, causing movement of the rack 94 and the pivoting or rotation of the plate 88. This results in the upward pivoting of the guide plates 72. Note that as the plate 88 moves from the FIG. 5A position to the FIG. 5B position, the outer ends of the links 84 move very little in an outward transverse direction compared to the movement of the plate, producing a slow final closing movement of the plates 72 of great mechanical advantage. This gives sufficient time for the carton in the gluing station to settle to its final resting position after its downstream movement stops before the plates 72 contact it to press the end panels up against the end flaps. Because the end panels will have been coated with adhesive the forceful and sustained contact between the end panels and the end flaps will result in the bonding together of the end panels to the end flaps. The carton in the sealing station at the time of shutdown will therefore not escape the gluing operation but will eventually emerge from the machine as a structurally intact carton.

The problem of carton failure due to the inability to seal the last carton to be glued prior to a machine shutdown has thus been overcome by the present invention. By making use of normally static guide plates to move the end panels into contact with the end flaps upon a machine shutdown, the machine length has been kept to a minimum and the distance the guide plates have to move has been minimized. With such short distances to move and with the simple actuating mechanism employed, the guide plates move immediately and very powerfully upon machine shutdown, resulting in a highly efficient, low maintenance arrangement.

It should be obvious that although a preferred embodiment of the invention has been disclosed, changes to certain of the details of the embodiment can be made without departing from the spirit and scope of the invention as defined in the claims.

What is claimed is:

1. In a machine for packaging articles in a tray carton comprising a bottom panel, side panels and end panels foldably connected to the bottom panel and end flaps foldably connected to the ends of the side panels:

means for conveying tray carton blanks downstream of the machine, the bottom panels of the blanks being supported by the conveying means, the end panels of the blanks being in their horizontal unfolded condition, and the side panels of the blanks being folded upwardly from the bottom panels and comprising the leading and trailing portions of the blanks;

means for moving articles to be packaged onto the bottom panel of the moving tray carton blanks;

means for folding the end flaps of the moving tray carton blanks toward each other;

means for applying glue to either the end panels or the end flaps of the moving tray carton blanks; and normally stationary means for folding the end panels up against the end flaps;

a portion of the normally stationary folding means being mounted for movement toward and away from the end flaps of a tray carton blank; and means for moving said portion of the normally stationary means toward the end flaps of a tray carton blank when the means for conveying the blanks downstream of the machine has stopped, whereby said portion of the normally stationary means will move the end panels of a stationary tray carton blank into contact with the end flaps thereof to adhere the end panels to the end flaps to complete the formation of a tray carton from the stationary tray carton blank.

2. A machine according to claim 1, wherein the normally stationary means for folding the end panels up against the end flaps comprises stationary first means for folding the moving end panels up from a flat unfolded position to an intermediate folded position, normally stationary second means for maintaining the moving end panels in their intermediate folded position, and stationary third means for folding the moving end panels up from their intermediate folded position to their final folded position against the end flaps.

3. A machine according to claim 2, wherein the normally stationary second means comprises the portion of the normally stationary means mounted for movement toward and away from the end flaps of a tray carton blank, the normally stationary second means being activated for movement upon the stopping of the packaging machine.

4. A machine according to claim 3, wherein the normally stationary second means comprises plate means mounted for pivotal movement toward and away from the end flaps of a tray carton blank.

5. A machine according to claim 4, wherein the plate means are attached to arms mounted for pivotal movement about horizontal axes located on either side of the path of movement of the tray carton blanks, the plates moving toward the end flaps when the bottom portions of the arms attached thereto are moved away from each other.

6. A machine according to claim 5, including links connecting the bottom portions of the arms to a plate mounted for rotation about a vertical axis, the links being connected to the plate on opposite sides of the vertical axis whereby the links move the bottom portions of the arms upon rotation of the plate.

7. A machine according to claim 6, wherein the plate has a pinion gear associated therewith, and wherein stopping of the packaging machine actuates a rack in engagement with the pinion gear to rotate the pinion gear and thus rotate the plate about its vertical axis.

8. In a method of packaging articles in a tray carton comprising a bottom panel, side and end panels foldably connected to the bottom panel, and end flaps foldably connected to the ends of the side panels, the steps of:

conveying tray carton blanks in a downstream direction, the side panels of the blanks being folded upwardly from the bottom panels and comprising the leading and trailing portions of the blanks;

moving articles to be packaged onto the bottom panel of the moving tray carton blanks;

folding the end flaps of the moving tray carton blanks in toward each other;

applying glue to either the end panels or the end flaps of the moving tray carton blanks;

moving the end panels over first stationary means for folding up the end panels to an intermediate position;

moving the end panels over second normally stationary means for maintaining the intermediate position of the end panels;

moving the end panels over third stationary means for folding up the end panels to bring them into contact with the end flaps; and when the machine stops, moving the second normally stationary means toward the end flaps of a stationary tray carton blank adjacent thereto to fold up the end panels of such a stationary blank to bring the end panels into contact with the end flaps of the blank, and holding the end panels in contact with the end flaps at least until the end panels are adhered to the end flaps.

* * * * *